US009685119B2

(12) United States Patent
Kim et al.

(10) Patent No.: US 9,685,119 B2
(45) Date of Patent: Jun. 20, 2017

(54) ORGANIC LIGHT EMITTING DISPLAY FOR COMPENSATING FOR VARIATIONS IN ELECTRICAL CHARACTERISTICS OF DRIVING ELEMENT

(71) Applicant: LG DISPLAY CO., LTD., Seoul (KR)

(72) Inventors: Taegung Kim, Paju-si (KR); Junghyeon Kim, Seoul (KR); Jinhan Yoon, Gimhae-si (KR)

(73) Assignee: LG Display Co., Ltd., Seoul (KR)

( * ) Notice: Subject to any disclaimer, the term of this patent is extended or adjusted under 35 U.S.C. 154(b) by 51 days.

(21) Appl. No.: 14/586,567

(22) Filed: Dec. 30, 2014

(65) Prior Publication Data

US 2015/0379937 A1 Dec. 31, 2015

(30) Foreign Application Priority Data

Jun. 26, 2014 (KR) ..... 10-2014-0079255

(51) Int. Cl.
*G09G 3/30* (2006.01)
*G09G 3/3291* (2016.01)
(Continued)

(52) U.S. Cl.
CPC ..... *G09G 3/3291* (2013.01); *G09G 3/006* (2013.01); *G09G 3/3233* (2013.01);
(Continued)

(58) Field of Classification Search
CPC .. G09G 3/3291; G09G 3/3258; G09G 3/3275; G09G 3/006; G09G 3/00;
(Continued)

(56) References Cited

U.S. PATENT DOCUMENTS 7,876,292 B2 * 1/2011 Cho ..... G09G 3/3233 315/169.3
2004/0100430 A1 5/2004 Fruehauf
(Continued)

FOREIGN PATENT DOCUMENTS

CN 102074181 B 7/2013
JP 11-219146 A 8/1999
(Continued)

*Primary Examiner* — Jimmy H Nguyen

(74) *Attorney, Agent, or Firm* — Birch, Stewart, Kolasch & Birch, LLP

(57) ABSTRACT

An organic light emitting display is provided which offers shorter sensing time and higher sensing accuracy when sensing variations in electrical characteristics of a driving element. The organic light emitting display can include: a display panel with a plurality of pixels; a gate driving circuit that generates a sensing gate pulse corresponding to one line sensing ON time in a sensing operation and sequentially supplies the same to gate lines in a line sequential manner; a data driving circuit comprising a plurality of current integrators that perform an integration of the source-drain current of the driving TFT of each pixel input through the sensing lines and an ADC that sequentially digitizes the output of the current integrators to output digital sensed values; and a timing controller that controls the operations of the gate driving circuit and data driving circuit.

12 Claims, 14 Drawing Sheets

(51) Int. Cl.

| | |
|---|---|
| ***G09G 3/3275*** | (2016.01) |
| ***G09G 3/00*** | (2006.01) |
| ***G09G 3/3258*** | (2016.01) |
| ***G09G 3/3233*** | (2016.01) |
| *G09G 3/3225* | (2016.01) |

(52) U.S. Cl.
CPC ..... *G09G 3/3258* (2013.01); *G09G 3/3275* (2013.01); *G09G 3/3225* (2013.01); *G09G 2300/0819* (2013.01); *G09G 2300/0828* (2013.01); *G09G 2310/027* (2013.01); *G09G 2310/0291* (2013.01); *G09G 2310/08* (2013.01); *G09G 2320/029* (2013.01); *G09G 2320/0223* (2013.01); *G09G 2320/045* (2013.01); *G09G 2330/12* (2013.01)

(58) Field of Classification Search
CPC ..... G09G 3/32; G09G 2300/0819; G09G 2300/0828; G09G 2310/027; G09G 2310/08; G09G 2310/0291; G09G 2320/0223; G09G 2320/029; G09G 2320/045; G09G 2330/12; G09G 3/3233
USPC ..... 345/690, 691, 76–81
See application file for complete search history.

(56) References Cited

U.S. PATENT DOCUMENTS

| | | | | |
|---|---|---|---|---|
| 2004/0246019 | A1 | 12/2004 | Nakano et al. | |
| 2009/0213046 | A1* | 8/2009 | Nam | G09G 3/3233 345/76 |
| 2010/0238149 | A1 | 9/2010 | Kishi et al. | |
| 2011/0122119 | A1* | 5/2011 | Bae | G09G 3/3233 345/211 |
| 2012/0056630 | A1* | 3/2012 | Itou | G01P 15/125 324/679 |
| 2012/0194099 | A1 | 8/2012 | White | |
| 2013/0050292 | A1 | 2/2013 | Mizukoshi | |
| 2013/0162617 | A1* | 6/2013 | Yoon | G09G 3/3291 345/211 |
| 2014/0022289 | A1* | 1/2014 | Lee | G09G 3/3283 345/691 |
| 2014/0092076 | A1 | 4/2014 | Lee | |
| 2014/0118377 | A1 | 5/2014 | Bae et al. | |
| 2014/0368415 | A1* | 12/2014 | Kim | G09G 3/3233 345/77 |
| 2015/0077411 | A1 | 3/2015 | Miyake | |
| 2015/0171156 | A1 | 6/2015 | Miyake | |
| 2015/0279324 | A1 | 10/2015 | Ohta et al. | |
| 2016/0055791 | A1* | 2/2016 | Kishi | G09G 3/3241 345/212 |

FOREIGN PATENT DOCUMENTS

| | | | |
|---|---|---|---|
| JP | 2004-192000 | A | 7/2004 |
| JP | 2004-347749 | A | 12/2004 |
| JP | 2007-256733 | A | 10/2007 |
| JP | 2010-281872 | A | 12/2010 |
| JP | 2010-281874 | A | 12/2010 |
| JP | 2014-510295 | A | 4/2014 |
| JP | 2015-79241 | A | 4/2015 |
| JP | 2015-132816 | A | 7/2015 |
| KR | 10-2011-0032937 | A | 3/2011 |
| KR | 10-2012-0041425 | A | 5/2012 |
| KR | 10-2014-0071303 | A | 6/2014 |
| KR | 10-2015-0052606 | A | 5/2015 |
| KR | 10-2015-0064798 | A | 6/2015 |
| TW | 201413682 | A | 4/2014 |
| TW | 20142144 | A | 6/2014 |
| TW | 201423702 | A | 6/2014 |
| WO | WO 2009/075129 | A1 | 6/2009 |
| WO | WO 2014/174905 | A1 | 10/2014 |

* cited by examiner

ORGANIC LIGHT EMITTING DISPLAY FOR COMPENSATING FOR VARIATIONS IN ELECTRICAL CHARACTERISTICS OF DRIVING ELEMENT

This application claims the priority benefit of Korean Patent Application No. 10-2014-0079255 filed on Jun. 26, 2014, which is incorporated herein by reference for all purposes as if fully asset forth herein.

BACKGROUND OF THE INVENTION

Field of the Invention

This document relates to an organic light emitting display, and more particularly, to an organic light emitting display which is capable of compensating for variations in electrical characteristics of a driving element.

Discussion of the Related Art

An active matrix-type organic light emitting display comprises a self-emissive organic light emitting diode (hereinafter, referred to as "OLED"), and offers advantages such as fast response speed, high light emission efficiency, high luminance, and wide viewing angle.

An OLED, which is a self-emissive element, comprises an anode, a cathode, and organic compound layers HIL, HTL, EML, ETL, and EIL formed between the anode and the cathode. The organic compound layers comprise a hole injection layer HIL, a hole transport layer HTL, an emission layer EML, an electron transport layer ETL, and an electron injection layer EIL. When a driving voltage is applied to the anode and the cathode, holes passing through the hole transport layer HTL and electrons passing through the electron transport layer ETL move to the emission layer EML to form excitons. As a result, the emission layer EML generates visible light.

In an organic light emitting display, pixels each including an OLED are arranged in a matrix form, and the luminance of the pixels is controlled according to the grayscale of video data. Each pixel comprises a driving element, i.e., driving thin film transistor (TFT), that controls the driving current flowing through the OLED in response to a voltage Vgs applied between its gate electrode and source electrode. Electrical characteristics of the driving TFT, such as threshold voltage, mobility, etc, may be deteriorated with the passage of driving time, causing variations from pixel to pixel. These variations in the electrical characteristics of the driving TFT between the pixels make difference in the luminance of the same video data between the pixels. This makes it difficult to realize a desired image.

An internal compensation method and an external compensation method are known to compensate for variations in electrical characteristics of a driving TFT. In the internal compensation method, variations in the threshold voltage of driving TFTs are automatically compensated for within a pixel circuit. The configuration of the pixel circuit is very complicated because the driving current flowing through the OLED has to be determined regardless of the threshold voltage of the driving TFTs for the sake of internal compensation. Moreover, the internal compensation method is inappropriate to compensate for mobility variations between the driving TFTs.

In the external compensation method, variations in electrical characteristics are compensated for by measuring sensed voltages corresponding to the electrical characteristics (threshold voltage and mobility) of the driving TFTs and modulating video data by an external circuit based on these sensed voltages. In recent years, research on the external compensation method is actively underway.

In the external compensation method according to the related art, a data driving circuit receives a sensed voltage from each pixel through a sensing line, converts the sensed voltage into a digital sensed value, and then transmits it to a timing controller. The timing controller modulates digital video data based on the digital sensed value and compensates for variations in electrical characteristics of a driving TFT.

As the driving TFT is a current element, its electrical characteristics are represented by the amount of current Ids flowing between a drain and a source in response to a given gate-source voltage Vgs. By the way, the data driving circuit of the conventional external compensation method senses a voltage corresponding to the current Ids, rather than sensing the current Ids flowing through the driving TFT, in order to sense the electrical characteristics of the driving TFT.

For instance, in the external compensation method disclosed in Korean Patent Application Nos. 10-2013-0134256 and 10-2013-0149395 filed by the present applicant, the driving TFT is operated in a source follower manner, and then a voltage (driving TFT's source voltage) stored in the line capacitor (parasitic capacitor) of the sensing line is sensed by the data driving circuit. In this external compensation method, the source voltage is sensed when the source electrode potential of the driving TFT DT operating in the source follower manner reaches a saturation state (i.e., the current Ids of the driving TFT DT becomes zero), in order to compensate for variations in the threshold voltage of the driving TFT. Also, in this external compensation method, a linear voltage is sensed before the source electrode potential of the driving TFT DT operating in the source follower manner reaches a saturation state, in order to compensate for variations in the mobility of the driving TFT.

The external compensation method according to the related art has the following problems.

First, the source voltage is sensed after the current flowing through the driving TFT is changed into the source voltage and stored by using the parasitic capacitor of the sensing line. In this case, the parasitic capacitance of the sensing line is rather large, and moreover the amount of parasitic capacitance may change with the display load of the display panel. Any change in the amount of parasitic capacitance where current is stored makes it difficult to obtain an accurate sensed value.

Second, it takes quite a long time to obtain a sensed value, for example, until the source voltage of the driving TFT is saturated, because the conventional external compensation method employs voltage sensing. Especially, if the parasitic capacitance of the sensing line is large, it takes much time to draw enough current to meet a voltage level at which sensing is enabled. This problem gets worse in the case of low-grayscale sensing.

SUMMARY OF THE INVENTION

An aspect of the present invention is to provide an organic light emitting display which offers shorter sensing time and higher sensing accuracy when sensing variations in electrical characteristics of a driving element.

An exemplary embodiment of the present invention provides an organic light emitting display comprising: a display panel with a plurality of pixels, each comprising an OLED and a driving TFT for controlling the amount of light emission of the OLED and being connected to any one of data lines, any one of gate lines, and any one of sensing lines; a gate driving circuit that generates a sensing gate pulse corresponding to one line sensing ON time in a sensing operation and sequentially supplies the same to the gate lines in a line sequential manner; a data driving circuit comprising a plurality of DACs that generate a sensing data voltage and supply the same to the data lines within one line sensing ON time in the sensing operation, a plurality of current integrators that perform an integration of the source-drain current of the driving TFT of each pixel input through the sensing lines, and an ADC that sequentially digitizes the output of the current integrators to output digital sensed values; and a timing controller that controls the operations of the gate driving circuit and data driving circuit to perform an integration of a first source-drain current caused by a sensing data voltage of a first level and an integration of a second source-drain current caused by a sensing data voltage of a second level within one line sensing ON time.

In on example, the first level is a voltage level corresponding to either a predetermined region of low grayscale current in the entire grayscale range or a predetermined region of high grayscale current in the entire grayscale range, and the second level is a voltage level corresponding to the other one.

The timing controller can control the operation of the gate driving circuit to generate the sensing gate pulse in multiple pulses so that two or more of the ON pulse region of the gate sensing pulse are included in one line sensing ON time.

The timing controller can control the sensing period in the first sensing & sampling period and the sensing period in the second sensing & sampling period according to the level of the sensing data voltage to differ in length from each other, and the sensing periods are adjusted to be inversely proportional to the level of the sensing data voltage.

In one embodiment, the organic light emitting display further comprises a capacitance controller for adjusting the capacitance of an integration capacitor included in the current integrator, the integration capacitor comprising a plurality of capacitors connected in parallel to the inverting input terminal of an amplifier, the other end of each of the capacitors being connected to the output terminal of the amplifier through different capacitance adjustment switches, wherein the timing controller controls the operation of the capacitance controller based on the result of analysis of the digital sensed values input form the ADC to generate a switching control signal for turning on/off the capacitance adjustment switches.

In one embodiment, the organic light emitting display further comprises a programmable voltage adjustment IC for adjusting ADC reference voltage by which the input voltage range of the ADC is determined, wherein the timing controller controls the operation of the programmable voltage adjustment IC based on the result of analysis of the digital sensed values to adjust the ADC reference voltage.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE ILLUSTRATED EMBODIMENTS

Hereinafter, embodiments of the present invention will be described with reference to FIGS. 1 to 16.

Figure 1:
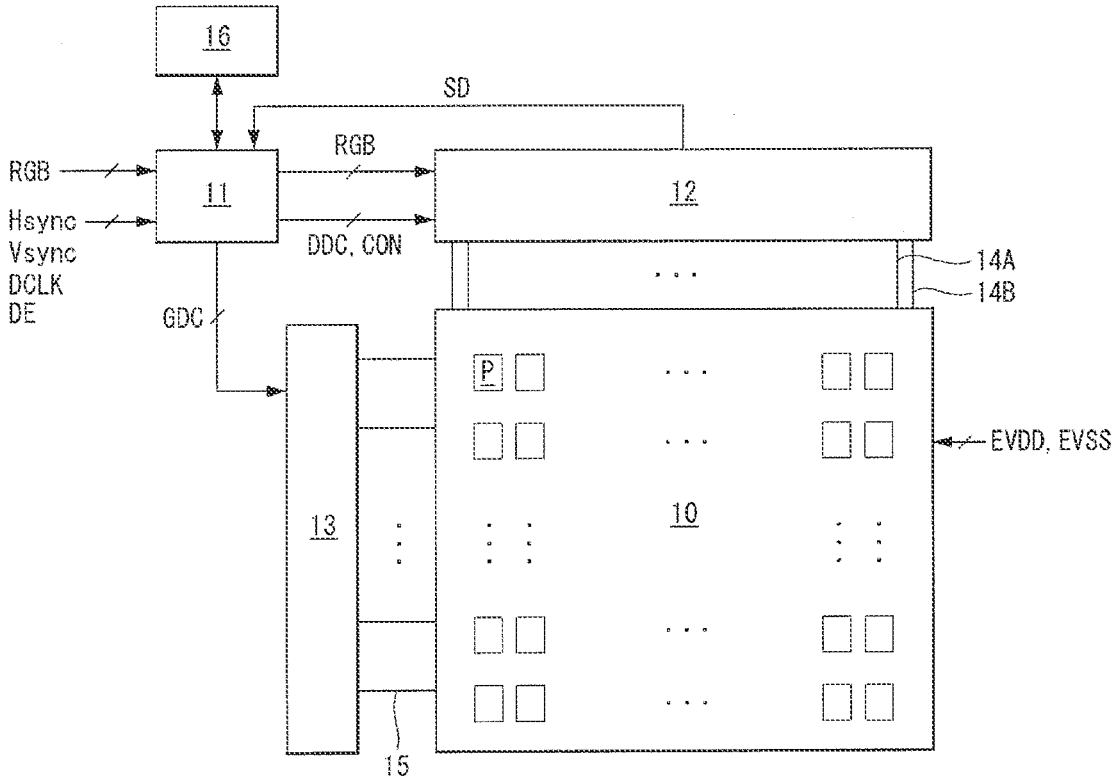
FIG. 1 is a view showing an organic light emitting display according to an exemplary embodiment of the present invention.
Figure 2:
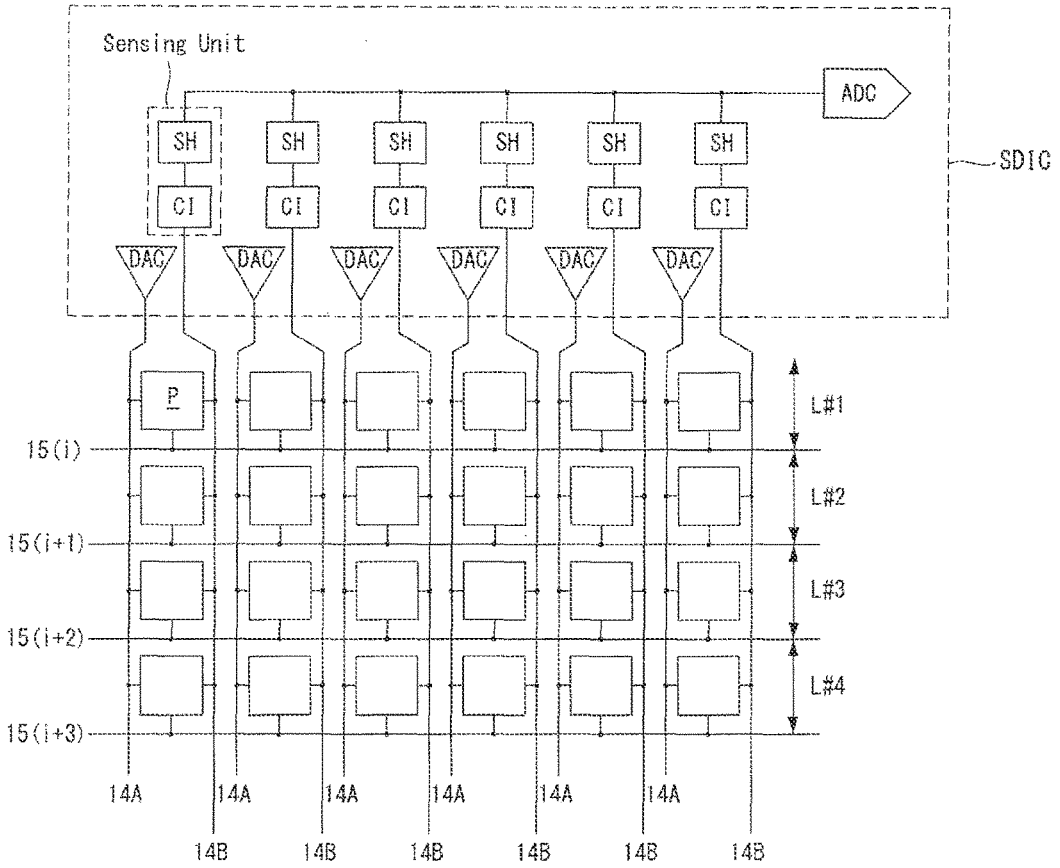
FIG. 2 is a view showing the configuration of a pixel array formed on the display panel of FIG. 1 and the configuration of a data driver IC for implementing a current sensing method according to an embodiment of the present invention.

FIG. 1 is a view showing an organic light emitting display according to an exemplary embodiment of the present invention. FIG. 2 is a view showing the configuration of a pixel array formed on the display panel of FIG. 1.

Referring to FIGS. 1 and 2, the organic light emitting display according to the exemplary embodiment of the present invention comprises a display panel 10, a timing controller 11, a data driving circuit 12, a gate driving circuit 13, and a memory 16. All the components of the organic light emitting display are operatively coupled and configured A plurality of data lines 14A and sensing lines 14B and a plurality of gate lines 15 cross over each other on the display panel 10, and pixels P are arranged in a matrix formed at their crossings.

Each pixel P is connected to any one of the data lines 14A, any one of the sensing lines 14B, and any one of the gate lines 15. Each pixel P is electrically connected to a data voltage supply line 14A to receive a data voltage form the data voltage supply line 14A and output a sensing signal through a sensing line 14B, in response to a gate pulse input through a gate line 15.

Each pixel P receives a high-potential driving voltage EVDD and a low-potential driving voltage EVSS from a power generator. A pixel P of this invention may comprise an OLED, a driving TFT, first and second switching TFTs, and a storage capacitor, for the sake of external compensation. The TFTs constituting the pixel P may be implemented as p-type or n-type. Also, a semiconductor layer of the TFTs constituting the pixel P may comprise amorphous silicon, polysilicon, or oxide.

Each pixel P may operate differently in a normal driving operation for displaying an image and in a sensing operation for obtaining a sensed value. Sensing may be per formed for a predetermined period of time before normal driving or for vertical blank periods during normal driving.

Normal driving may occur when the data driving circuit 12 and the gate driving circuit 13 operate normally under the control of the timing controller 11. Sensing may occur when the data driving circuit 12 and the gate driving circuit 13 perform a sensing operation under the control of the timing controller 11. An operation of deriving compensation data for variation compensation based on a sensing result and an operation of modulating digital video data using compensation data are carried out by the timing controller 11.

The data driving circuit 12 comprises at least one data driver IC (integrated circuit) SDIC. The data driver IC SDIC comprises a plurality of digital-to-analog converters (hereinafter, DACs) connected to each data line 14A, a plurality of sensing units connected to each sensing line 14B, and an ADC connected commonly to the output terminals of the sensing units.

In a normal driving operation, the DAC of the data driver IC SDIC converts digital video data RGB into a data voltage for image display and supplies it to the data lines 14A, in response to a data timing control signal DDC applied from the timing controller 11. On the other hand, in a sensing operation, the DAC of the data driver IC SDIC generates a sensing data voltage and supplies it to the data lines 14A, in response to a data timing control signal DDC applied from the timing controller 11.

Each sensing unit of the data driver IC SDIC comprises a current integrator CI that performs an integration of a sensing signal from a pixel P input through a sensing line 14B, i.e., a source-drain current of the driving TFT, and a sampler SH for sampling and holding the output of the current integrator CI. The ADC of the data driver IC SDIC sequentially digitizes the output of the samplers SH and transmits it to the timing controller 11.

In the normal driving operation, the gate driving circuit 13 generates a gate pulse for image display based on a gate control signal GDC and then sequentially supplies it to the gate lines 15 in a line sequential manner L#1, L#2, . . . . In the sensing operation, the gate driving circuit 13 generates a sensing gate pulse based on the gate control signal GDC and then sequentially supplies it to the gate lines 15 in a line sequential manner L#1, L#2, . . . . The sensing gate pulse may have a larger ON pulse region than the gate pulse for image display. One (see FIG. 6) or multiple (see FIG. 7) ON pulse regions of the sensing gate pulse may be included within one line sensing ON time. Here, one line sensing ON time denotes the scan time taken to simultaneously sense the pixels of one pixel line L#1, L#2, . . . .

The timing controller 11 generates a data control signal DDC for controlling the operation timing of the data driving circuit 12 and a gate control signal GDC for controlling the operation timing of the gate driving circuit 13, based on timing signals such as a vertical synchronization signal Vsync, a horizontal synchronization signal Hsync, a dot clock signal DCLK, and a data enable signal DE. The timing controller 11 identifies normal driving and sensing based on a predetermined reference signal (driving power enable signal, vertical synchronization signal, data enable signal, etc), and generates the data control signal DDC and the gate control signal GDC depending on each driving operation. The timing controller 11 may generate additional control signals (RST, SAM, HOLD, etc. of FIG. 3) required for sensing.

In the sensing operation, the timing controller 11 may transmit digital data corresponding to a sensing data voltage to the data driving circuit 12. In the sensing operation, the timing controller 11 applies a digital sensed value SD transmitted from the data driving circuit 12 to a pre-stored compensation algorithm to derive a threshold voltage variation ΔVth and a mobility variation ΔK, and then stores compensation data in a memory 16 to compensate for these variations.

In the normal driving operation, the timing controller 11 modulates digital video data RGB for image display with reference to the compensation data stored in the memory 16 and then transmits it to the data driving circuit 12.

Figure 3:
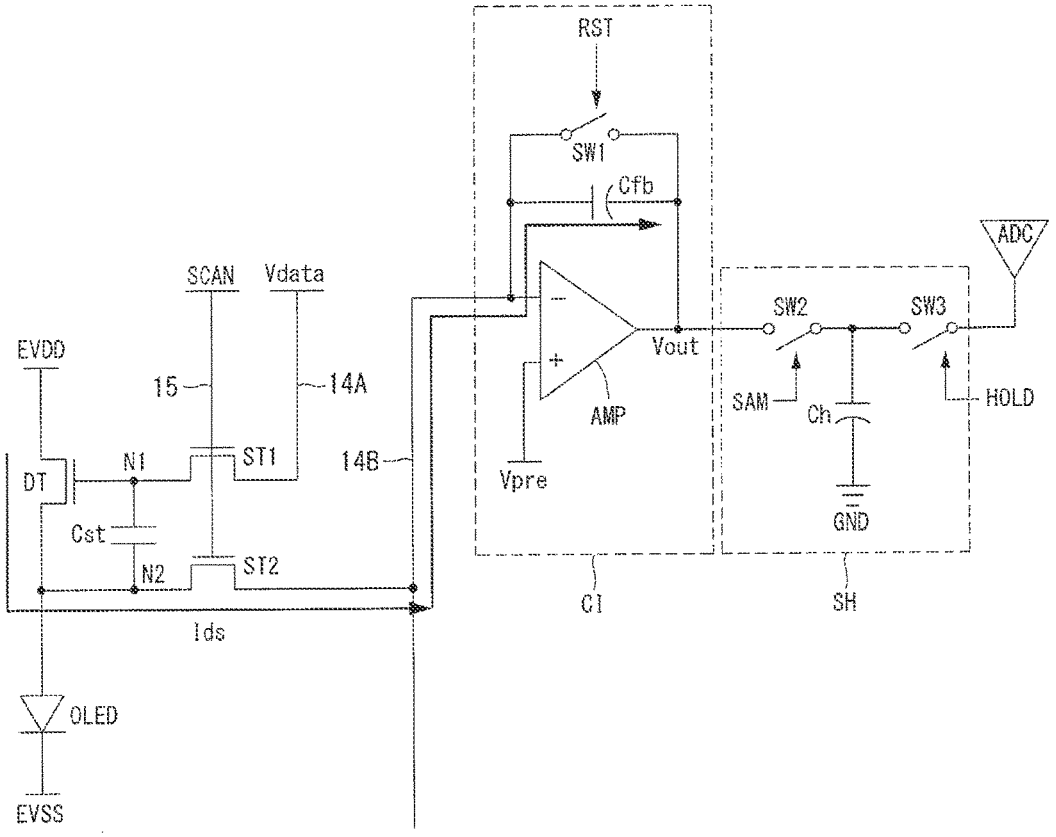
FIGS. 3 and 4 show a connection structure of a pixel and a sensing unit to which a current sensing method of the present invention is applied and a sensing principle for the same.
Figure 4:
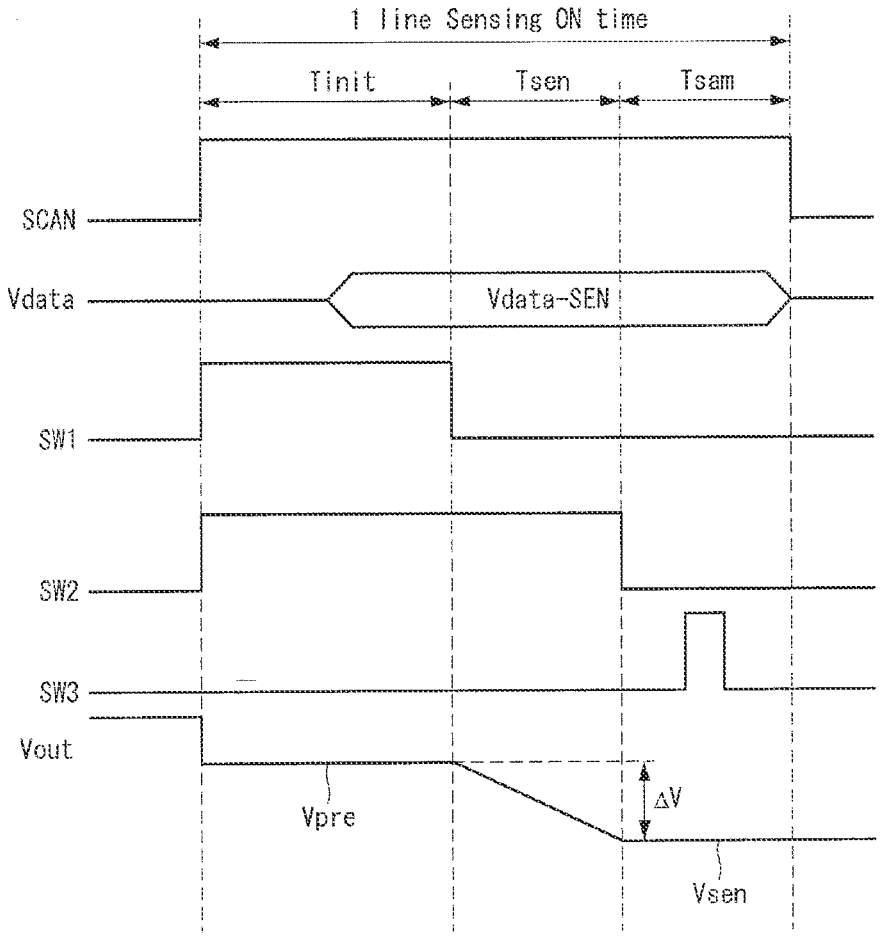

FIGS. 3 and 4 show a connection structure of a pixel P and a sensing unit to which a current sensing method of the present invention is applied and a sensing principle for the same.

FIGS. 3 and 4 are only an example for helping understanding of driving of the current sensing method. A pixel structure using the current sensing method of this invention and the timing for driving it can be altered in various ways, so the technical spirit of the present invention is not limited to this example.

Referring to FIG. 3, a pixel PIX of the present invention may comprise an OLED, a driving thin film transistor (TFT) DT, a storage capacitor Cst, a first switching TFT ST1, and a second switching TFT ST2.

The OLED comprises an anode connected to a second node N2, a cathode connected to the input terminal of a low-potential driving voltage EVSS, and an organic compound layer located between the anode and the cathode. The driving TFT DT controls the amount of current going into the OLED according to a gate-source voltage Vgs. The driving TFT DT comprises a gate electrode connected to a first node N1, a drain electrode connected to the input terminal of a high-potential driving voltage EVDD, and a source electrode connected to the second node N2. The storage capacitor Cst is connected between the first node N1 and the second node N2. The first switching TFT ST1 applies a data voltage Vdata on a data voltage supply line 14A to the first node N1 in response to a gate pulse SCAN. The first switching TFT ST1 comprises a gate electrode connected to a gate line 15, a drain electrode connected to the data voltage supply line 14A, and a source electrode connected to the first node N1. The second switching TFT ST2 switches the flow of current between the second node N2 and a sensing line 14B in response to a gate pulse SCAN. The second switching TFT ST2 comprises a gate electrode connected to a second gate line 15D, a drain electrode connected to the sensing line 14B, and a source electrode connected to the second node N2.

A current integrator CI included in a sensing unit of this invention comprises an amplifier AMP comprising an inverting input terminal (−) connected to the sensing line 14B and receiving the source-drain current Ids of the driving TFT from the sensing line 14B, an non-inverting input terminal (+) receiving a reference voltage Vpre, and an output terminal for outputting an integrated value Vsen, an integration capacitor Cfb connected between the inverting input terminal (−) and output terminal of the amplifier AMP, and a first switch SW1 connected to both ends of the integration capacitor Cfb.

A sampler SH included in the sensing unit of this invention comprises a second switch SW2 that is switched on in response to a sampling signal SAM, a third switch SW3 that is switched on in response to a holding signal HOLD, and a holding capacitor Ch whose one end is connected between the second switch SW2 and the third switch SW3 and whose the other end is connected to a ground voltage source GND.

FIG. 4 depicts the waveform of one sensing operation for each of the pixels arranged on the same line within one line sensing ON time defined by the ON pulse region of a sensing gate pulse SCAN. Referring to FIG. 4, the sensing operation is performed in several periods including an initialization period Tinit, a sensing period Tsen, and a sampling period Tsam.

In the initialization period Tinit, the amplifier AMP operates as a unit gain buffer with a gain of 1 by the turn-on of the first switch SW1. In the initialization period Tinit, the input terminals (+, −) and output terminal of the amplifier AMP, the sensing line 14B, and the second node N2 are all initialized to the reference voltage Vpre.

During the initialization period Tinit, a sensing data voltage Vdata-SEN is applied to the first node N1 through the DAC of the data driver IC SDIC. Accordingly, a source-drain current Ids corresponding to a potential difference {(Vdata-SEN)−Vpre} between the first node N1 and the second node N2 is stabilized as it flows to the driving TFT DT. However, since the amplifier AMP continues to act as the unit gain buffer during the initialization period, the potential of the output terminal is maintained at the reference voltage Vpre.

In the sensing period Tsen, the amplifier AMP operates as the current integrator CI by the turn-off of the first switch SW1 to perform an integration of the source-drain current Ids flowing through the driving TFT DT. In the sensing period Tsen, the potential difference between both ends of the integration capacitor Cfb increases due the current Ids entering the inverting input terminal (−) of the amplifier AMP as the sensing time passes, i.e., the value of stored current Ids increases. However, the inverting input terminal (−) and the non-inverting input terminal (+) are shorted through a virtual ground due to the nature of the amplifier AMP, and the potential difference between the inverting input terminal (−) and the non-inverting input terminal (+) is zero. Therefore, the potential of the inverting input terminal (−) is maintained at the reference voltage Vpre in the sensing period Tsen, regardless of whether the potential difference across the integration capacitor Cfb has increased or not. Instead, the output terminal potential of the amplifier AMP decreases in response to the potential difference between both ends of the integration capacitor Cfb. Based on this principle, the current Ids entering through the sensing line 14B in the sensing period 2 is converted to an integrated value Vsen, which is a voltage value, through the integration capacitor Cfb. The falling slope of the output Vout of the current integrator CI increases as the amount of current Ids entering through the sensing line 14B becomes larger. Therefore, the larger the amount of current Ids, the smaller the integrated value Vsen. In the sensing period Tsen, the integrated value Vsen passes through the second switch SW2 and is stored in the holding capacitor Ch.

In the sampling period Tsam, when the third switch SW3 is turned on, the integrated value Vsen stored in the holding capacitor Ch passes through the third switch SW3 and is input into the ADC. The integrated value Vsen is converted into a digital sensed value SD by the ADC and then transmitted to the timing controller 11. The digital sensed value SD is used for the timing controller 11 to derive a threshold voltage variation ΔVth of the driving TFT and a mobility variation ΔK of the driving TFT. The timing controller 11 stores the capacitance of the integration capacitor Cfb, the reference voltage Vpre, and the sensing time Tsen are pre-stored in digital code. Accordingly, the timing controller 11 is able to calculate the source-drain current Ids=Cfb*ΔV/Δt (wherein ΔV=Vpre−Vsen and Δt=Tsen) from the digital sensed value SD, which is a digital code for the integrated value Vsen. The timing controller 11 applies the source-drain current Ids flowing through the driving TFT DT to a compensation algorithm to derive variations (a threshold voltage variation ΔVth and a mobility variation ΔK) and compensation data (Vth+ΔVth and K+ΔK). The compensation algorithm may be implemented as a look-up table or a calculational logic.

The capacitance of the integration capacitor Cfb included in the current integrator CI of this invention is only one-several hundredths of the parasitic capacitance existing across the sensing line. Thus, the current sensing method of this invention can drastically reduce the time taken to draw enough current Ids to meet the integrated value Vsen with which sensing is enabled, as compared to a conventional voltage sensing method. Moreover, in the conventional voltage sensing method, it takes quite a long time to sense a threshold voltage because the source voltage of the driving TFT is sampled as a sensed voltage after it is saturated; whereas, in the current sensing method, it takes much less time to sense a threshold voltage and mobility because an integration of the source-drain current of the driving TFT and sampling of the integration value can be performed within a short time by means of current sensing.

Also, the integration capacitor Cfb included in the current integrator CI of this invention is able to obtain an accurate sensed value because its stored values do not change with display load but can be easily calibrated, unlike the parasitic capacitor of the sensing line.

As such, the current sensing method of this invention has advantages over the related art voltage sensing method because it is capable of low current sensing and high-speed sensing. For this reason, the current sensing method of this invention allows performing sensing on each pixel multiple times within one line sensing ON time in order to improve sensing performance.

Figure 5:
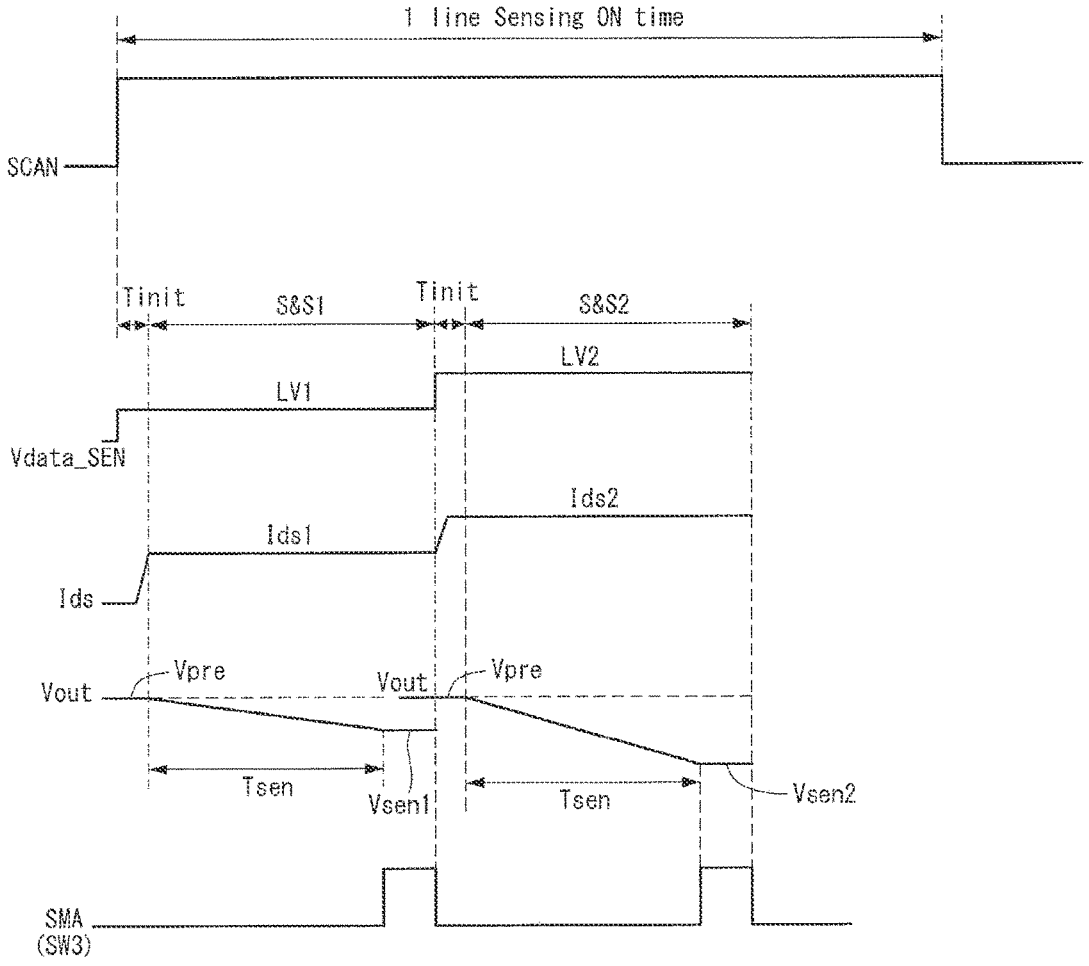
FIGS. 5 and 6 show one driving waveform of a multi-time current sensing method according to an embodiment of the present invention to improve sensing performance and the driving procedure of this device.
Figure 6:
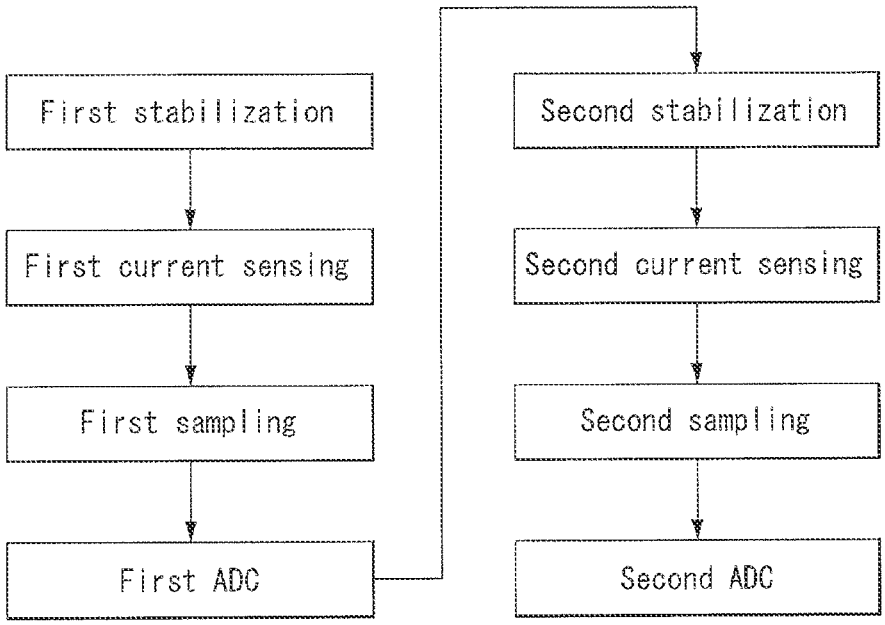
Figure 7:
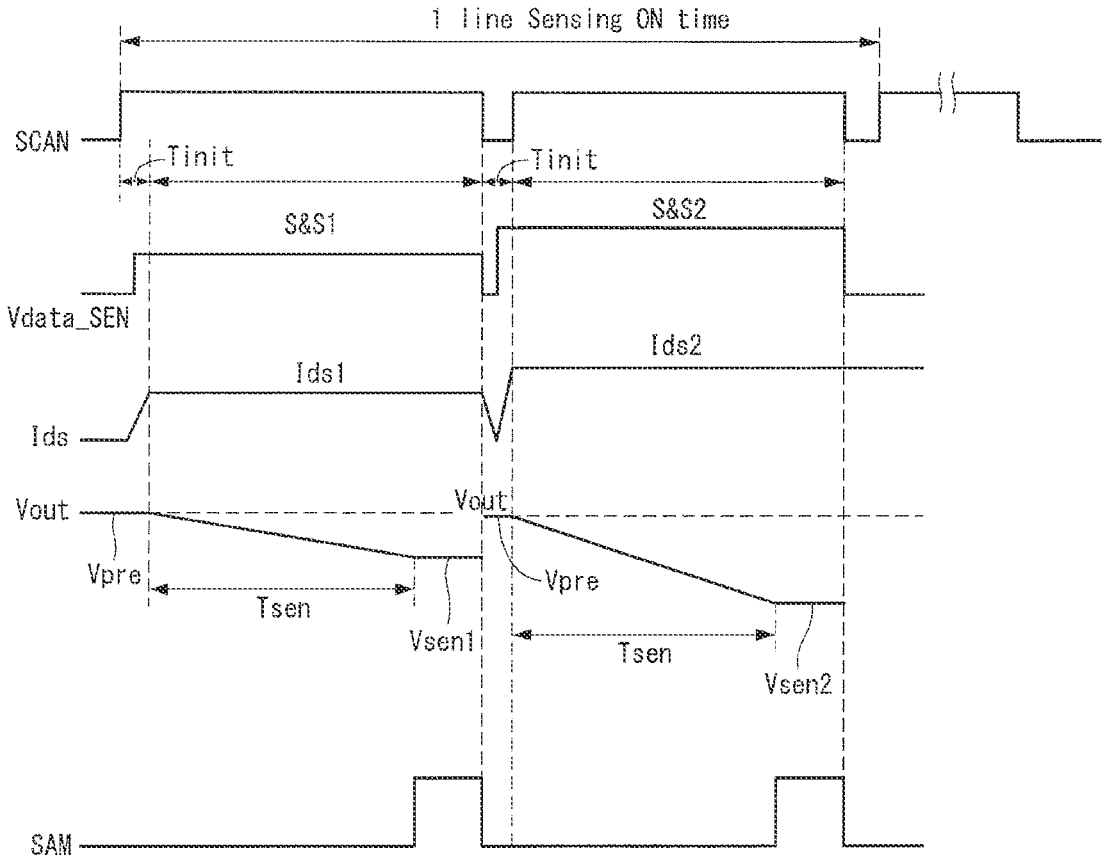
FIG. 7 shows another driving waveform of the multi-time sensing method of the present invention.

FIGS. 5 and 6 show one driving waveform of a multi-time current sensing method of the present invention to improve sensing performance and the driving procedure of this device. FIG. 7 shows another driving waveform of the multi-time sensing method of the present invention. Although FIGS. 5 to 7 illustrate the multi-time current sensing of the present invention by taking an example where current sensing is performed twice, the technical spirit of the present invention is also applicable when current sensing is performed three times or more.

Referring to FIGS. 5 and 6, sensing and sampling can be performed on the same pixel twice within one line sensing ON time corresponding to 1 ON pulse region of a sensing gate pulse SCAN. To this end, the timing controller 11 may control the operations of the driving circuits 12 and 13 so that one line sensing ON time comprises a first sensing & sampling period S&S1 for performing an integration of a first source-drain current Ids1 caused by a sensing data voltage VData-SEN of a first level LV1 and a second sensing & sampling period S&S2 for performing an integration of a second source-drain current Ids2 caused by a sensing data voltage VData-SEN of a second level LV2. Also, the timing controller 11 may place initialization periods Tinit prior to the first and second sensing & sampling periods S&S1 and S&S2, respectively.

The sensing data voltages VData-SEN of the first level LV1 and second level LV2 may be the same but preferably differ in order to increase sensing performance. The first level LV1 corresponds to a predetermined region of low grayscale current Ids1 in the entire grayscale range and the second level LV2 corresponds to a predetermined region of high grayscale current Ids2 in the entire grayscale range, or vice versa. That is, the first level LV1 may be a voltage level corresponding to either a predetermined region of low grayscale current Ids1 in the entire grayscale range or a predetermined region of high grayscale current Ids2 in the entire grayscale range, and the second level LV2 may be a voltage level corresponding to the other one.

In the first initialization period Tinit, the same operations as in the initialization period Tinit of FIG. 4, that is, an initialization operation and a source-drain current stabilization operation are firstly performed.

In the second sensing & sampling period S&S2, the same operations as in the sensing period Tsen and sampling period Tsam of FIG. 4 are performed; the second source-drain current Ids2 is sensed and secondly integrated, a second integrated value Vsen2 is sampled and secondly analog-to-digital converted, and then a second digital sensed value is stored in an internal latch.

In the second initialization period Tinit, the same operations as in the initialization period Tinit of FIG. 4, that is, an initialization operation and a source-drain current stabilization operation are secondly performed.

In the second sensing & sampling period S&S2, the same operations as in the sensing period Tsen and sampling period Tsam of FIG. 4 are performed; the second source-drain current Ids2 is sensed and secondly integrated, a second integrated value Vsen2 is sampled and secondly analog-to-digital converted, and then a second digital sensed value is stored in an internal latch.

The sensing periods Tsen included in the first and second sensing & sampling periods S&S1 and S&S2, respectively, are equal in length.

The timing controller 11 calculates the first and second source-drain currents Ids1 and Ids2 based on the first and second digital sensed values, and derives variations ΔVth and ΔK by using a calculational logic or look-up table.

Using the calculational logic, the timing controller 11 applies the calculated first and second source-drain currents Ids1 and Ids2 to an OLED current equation ($Ids=K(Vgs-Vth)^2$) to obtain two current equations ($Ids1=K(Vgs1-Vth)^2$) and ($Ids2=K(Vgs2-Vth)^2$), first calculates the threshold voltage Vth of the corresponding pixel using these equations, and then calculates the mobility K by putting the value of the threshold voltage Vth to any one of the OLED current equations. Next, the calculated threshold voltage Vth and mobility K are compared with pre-stored reference values to derive the variations ΔVth and ΔK.

Figure 16:
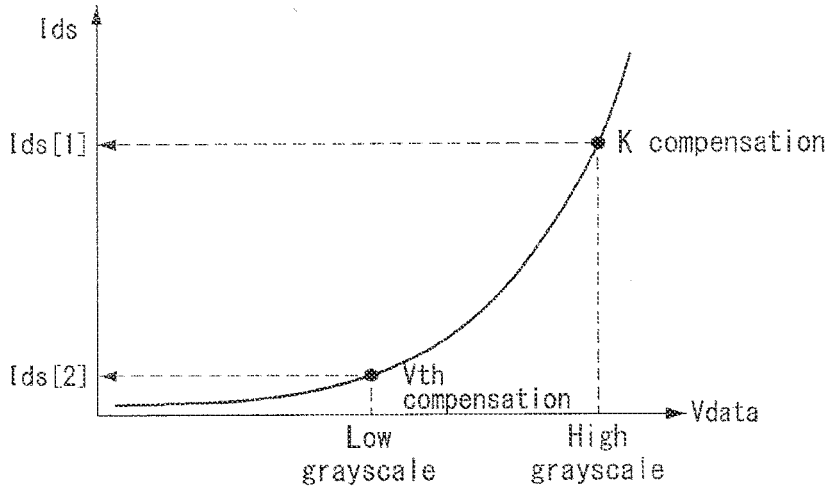
FIG. 16 is a view showing an example of a compensation method using a look-up table according to an embodiment of the present invention.

Using the look-up table, the timing controller 11 calculates first and second current deviations by comparing the calculated threshold voltage Vth and mobility K with pre-stored reference values, and derives a threshold variation ΔVth and a mobility variation ΔK by using the first and second current variations as read addresses. It is commonly known that the source-drain current of the driving TFT is affected much by changes in threshold voltage changes in a low grayscale region and by changes in mobility in a high grayscale region. Accordingly, as shown in FIG. 16, the timing controller 11 is able to derive the threshold voltage variation Vth based on the first source-drain current Idsd1, which is the higher of the two, and the mobility variation ΔK based on the second source-drain current Ids2, which is the lower of the two.

In order to apply the same stabilization condition for the first and second sensing & sampling periods S&S1 and S&S2, the timing controller 11 may control the operation of the gate driving circuit 13 to generate the sensing gate pulse SCAN in multiple pulses so that two or more of the ON pulse region of the gate sensing pulse SCAN are included in one line sensing ON time. The stabilization condition may comprise gate delay, data charging delay, etc.

Figure 8:
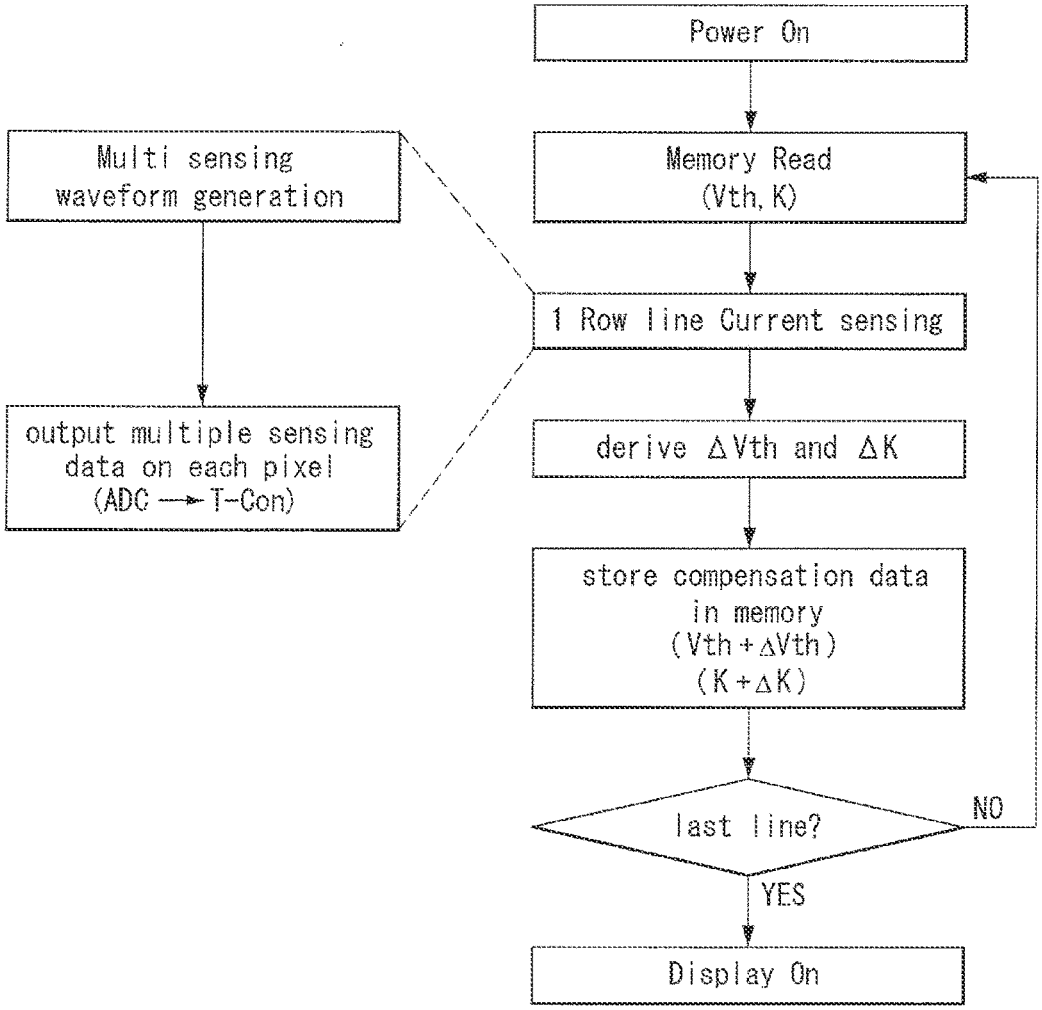
FIG. 8 shows a flow of compensation while the power is on according to an embodiment of the present invention.
Figure 9:
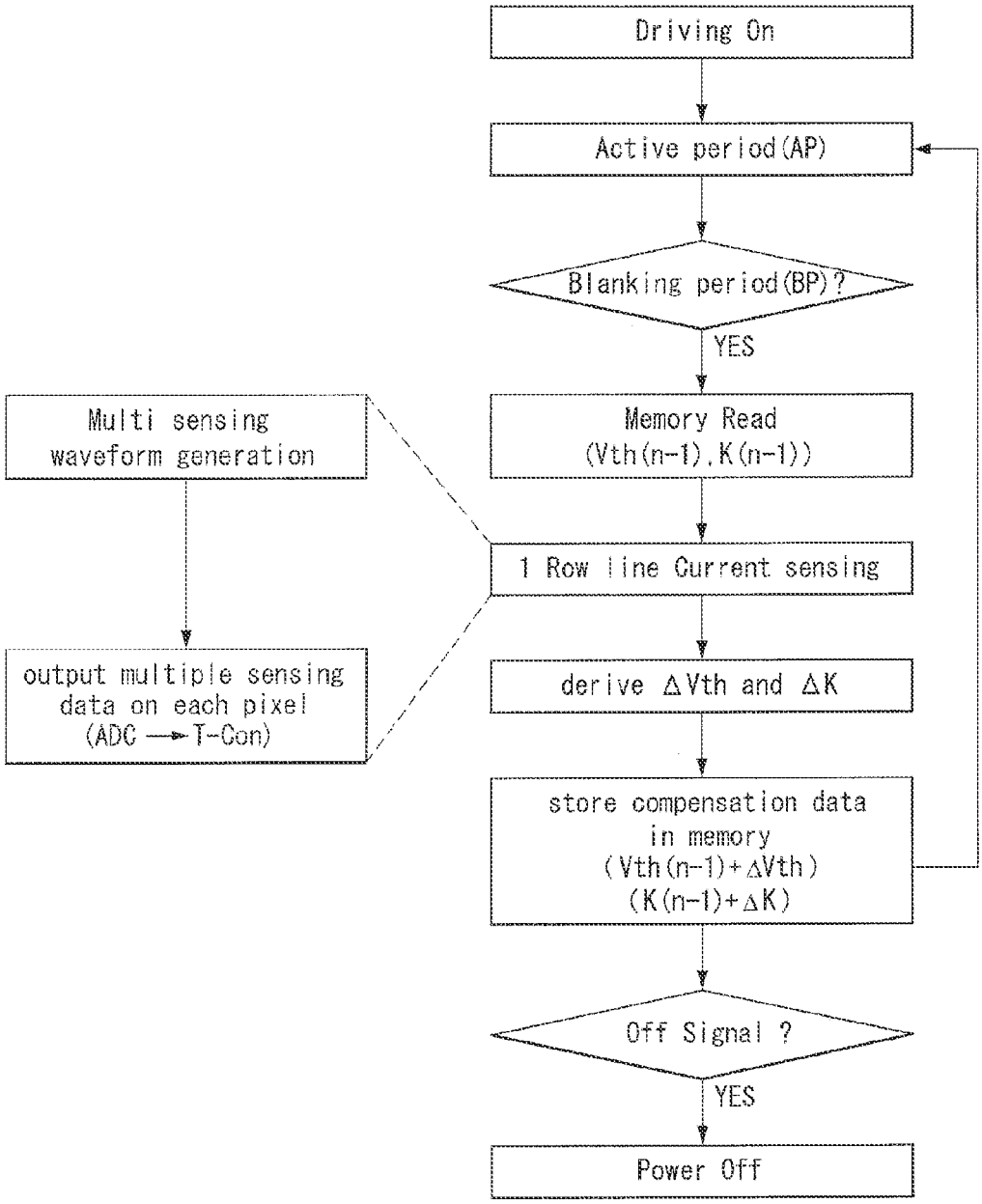
FIG. 9 shows a flow of compensation during a real-time driving operation according to an embodiment of the present invention.
Figure 10A:
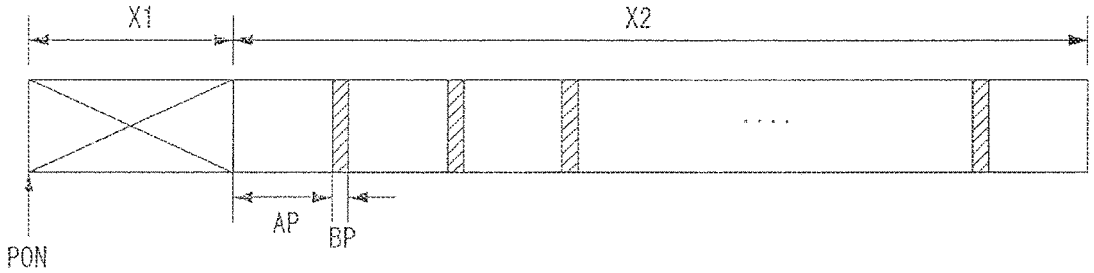
FIGS. 10A and 10B show a predetermined initial non-display period, active periods, and vertical blank periods while the power is on according to an embodiment of the present invention.
Figure 10B:
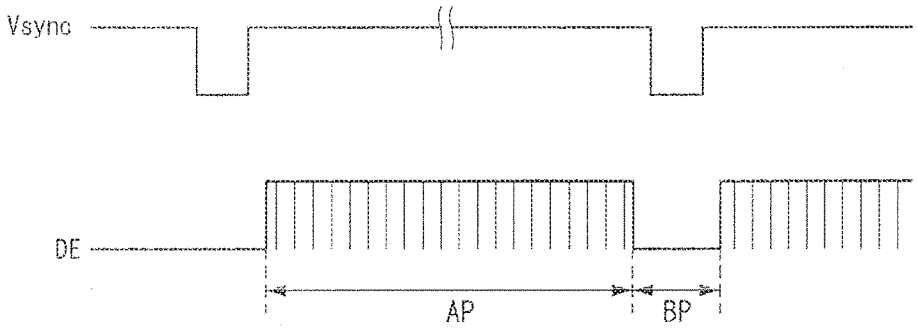

FIG. 8 shows a flow of compensation while the power is on. FIG. 9 shows a flow of compensation during a real-time driving operation. FIGS. 10A and 10B show a predetermined initial non-display period, active periods, and vertical blank periods while the power is on.

The flow of compensation of FIG. 8 involves a sensing operation performed on all pixels during a predetermined initial non-display period X1 preceding a normal driving operation. The flow of compensation of FIG. 9 involves a sensing operation performed on one pixel line in vertical blank periods BP of the normal driving operation.

As shown in FIG. 10A, the initial non-display period X1 may be defined by a non-display period that lasts for several tens or hundreds of frames after the point of application of a driving power enable signal PON. As shown in FIGS. 10A and 10B, the vertical blank periods BP may be defined by non-display periods between active periods AP during which an image is displayed. No data enable signal DE is generated in the initial non-display period X1 and the vertical blank periods BP, and accordingly no image display data voltage is supplied to the pixels in the vertical blank periods BP.

Referring to FIG. 8, the flow of compensation during the initial non-display period X1 will be schematically explained again. In the present invention, the threshold voltage Vth and mobility K stored in the previous compensation period are read out from the memory when the power is on. Next, the aforementioned multi-time current sensing method is applied to each pixel line in a line sequential manner to obtain multiple digital sensed values, and the current threshold voltage Vth and mobility K are derived based on these digital sensed values. Next, the derived current threshold voltage Vth and mobility K are compared with the threshold voltage Vth and mobility K input from the memory to derive a threshold variation ΔVth and a mobility variation ΔK, and then compensation data Vth+ΔVth and K+ΔK for compensating the variations is stored in the memory.

Referring to FIG. 9, the flow of compensation for each pixel line during the vertical blank periods BP of the normal driving operation will be schematically explained again. In the present invention, the threshold voltage Vth and mobility K stored in the previous compensation period are read out from the memory in the vertical blank periods BP. Next, the aforementioned multi-time current sensing method is applied to each pixel line in a line sequential manner to obtain multiple digital sensed values, and the current threshold voltage Vth and mobility K are derived based on these digital sensed values. Next, the derived current threshold voltage Vth and mobility K are compared with the threshold voltage Vth(n−1) and mobility K(n−1) input from the memory to derive a threshold variation ΔVth and a mobility variation ΔK, and then compensation data Vth+ΔVth and K+ΔK for compensating the variations is stored in the memory.

Figure 11:
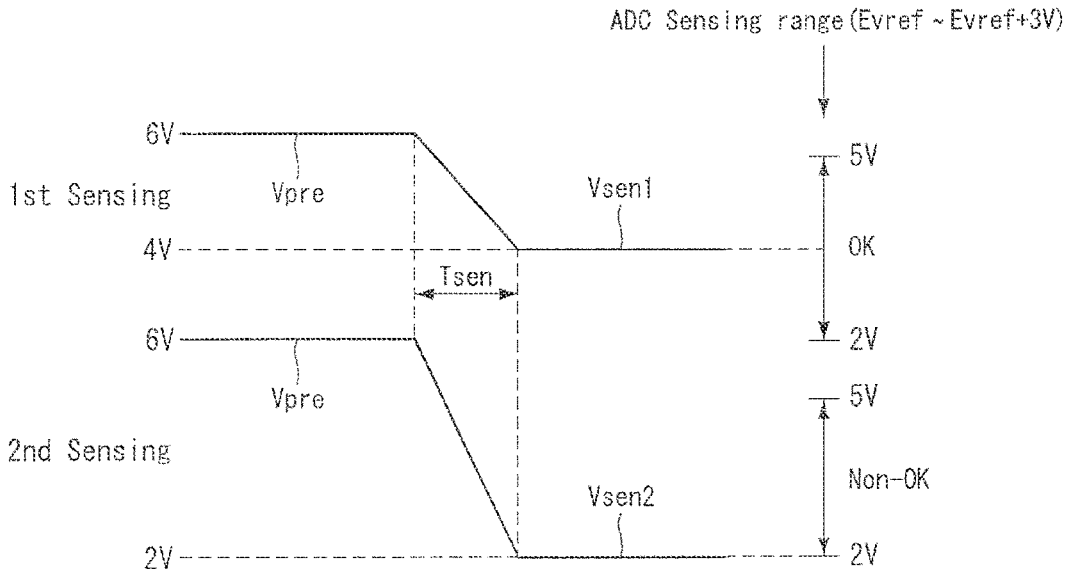
FIG. 11 shows ADC over-range observed in the multi-time current sensing method of the present invention.

FIG. 11 shows ADC over-range observed in the multi-time current sensing method of the present invention.

An ADC is a special encoder which converts an analog signal into data in the form of a digital signal. The ADC has a fixed input voltage range, i.e., fixed sensing range. Although the voltage range of the ADC may differ depending on the resolution of AD conversion, it is usually set to Evref (ADC reference voltage) to Evref+3V. The resolution of AD conversion is the number of bits that are used to convert an analog input voltage into a digital value. If an analog signal input into the ADC is out of the input range of the ADC, underflow occurs where the ADC's output is smaller than the smallest value of the input voltage range, or overflow occurs where the ADC's output is larger than the largest value of the input voltage range.

In the present invention, different analog integrated values Vsen are generated by performing sensing on each pixel at least twice according to the multi-time current sensing method. As stated above, the larger the current Ids flowing into the current integrator CI, the smaller the output integrated value Vsen, or the smaller the current Ids flowing into the current integrator CI, the larger the output integrated value Vsen. Accordingly, part of the different integrated values might be output the input range of the ADC.

More specifically, with reference to FIG. 11, it is assumed that if the input range of the ADC is 2V to 5V, a first integrated value Vsen1 corresponding to a first current Ids1 is 4V and a second integrated value corresponding to a second current Ids2, larger than the first current Ids1, is 1.5V.

While the first integrated value Vsen1 of 4V is within the input range (2V to 5V) of the ADC and is normally output, the second integrated value Vsen2 of 1.5V is out of the input range (2V to 5V) of the ADC and thus underflows because it is smaller than the smallest value 2V of the input voltage range of 2V to 5V.

When such ADC over-range occurs, sensing accuracy is lowered. Accordingly, there is a need for an additional solution to prevent ADC over-range.

Figure 12:
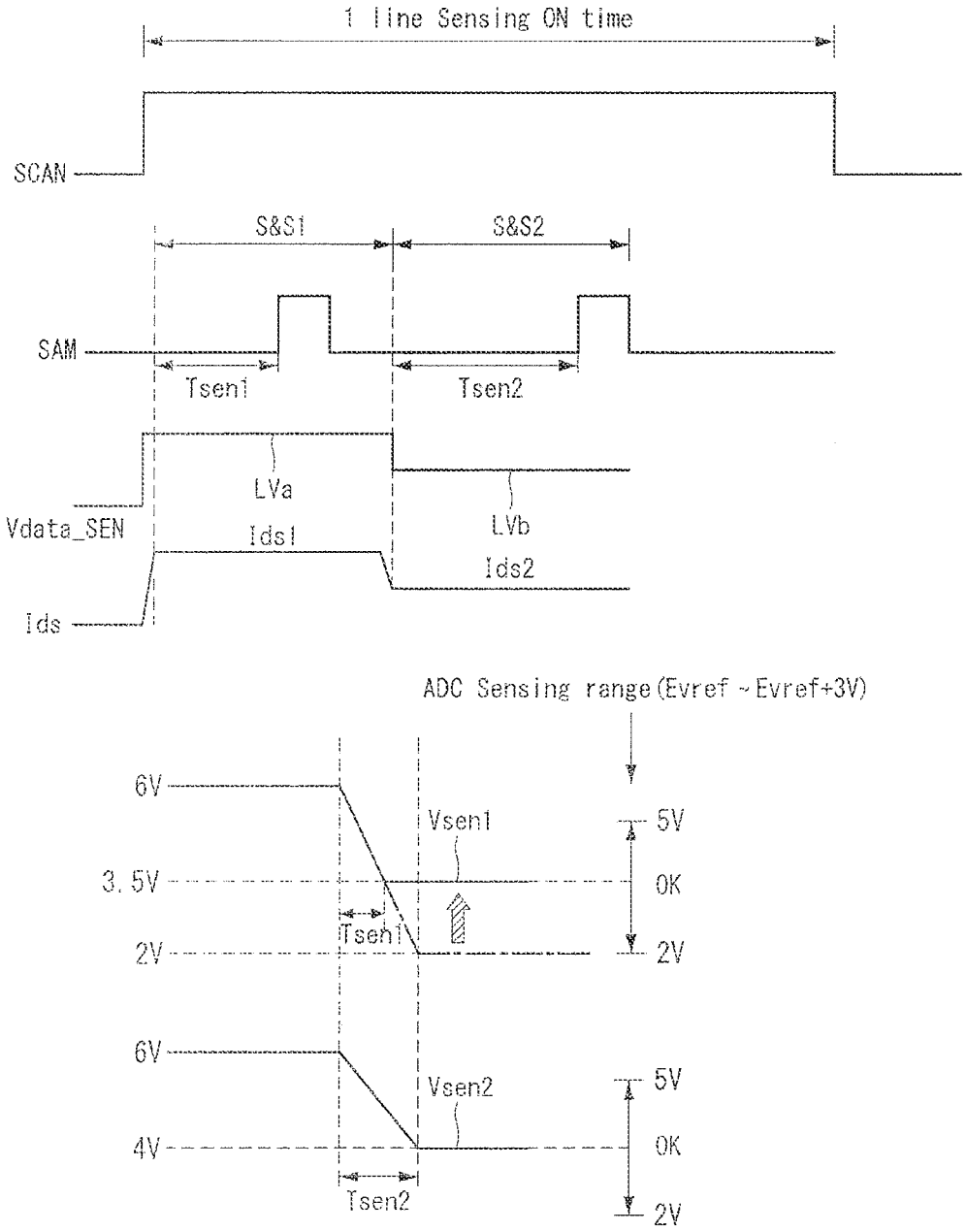
FIG. 12 shows one solution to prevent ADC over-range according to an embodiment of the present invention.

FIG. 12 shows one solution to prevent ADC over-range according to an embodiment of the present invention.

In the multi-time current sensing method according to the present invention, as shown in FIG. 12, the first integrated value Vsen1 will underflow more likely in the first sensing & sampling period S&S1, in which the falling slope of the output Vout of the current integrator CI is larger, than in the second sensing & sampling period S&S2, in which the falling slope of the output Vout of the current integrator CI is smaller.

In this case, the first integrated value Vsen1 can be adjusted upward from 2V to 3.5V for correction to satisfy the input voltage range (2V to 5V) of the ADC by making the sensing period Tsen1 of the first sensing & sampling period S&S1 shorter than the sensing period Tsen2 of the second sensing & sampling period S&S2.

Figure 13:
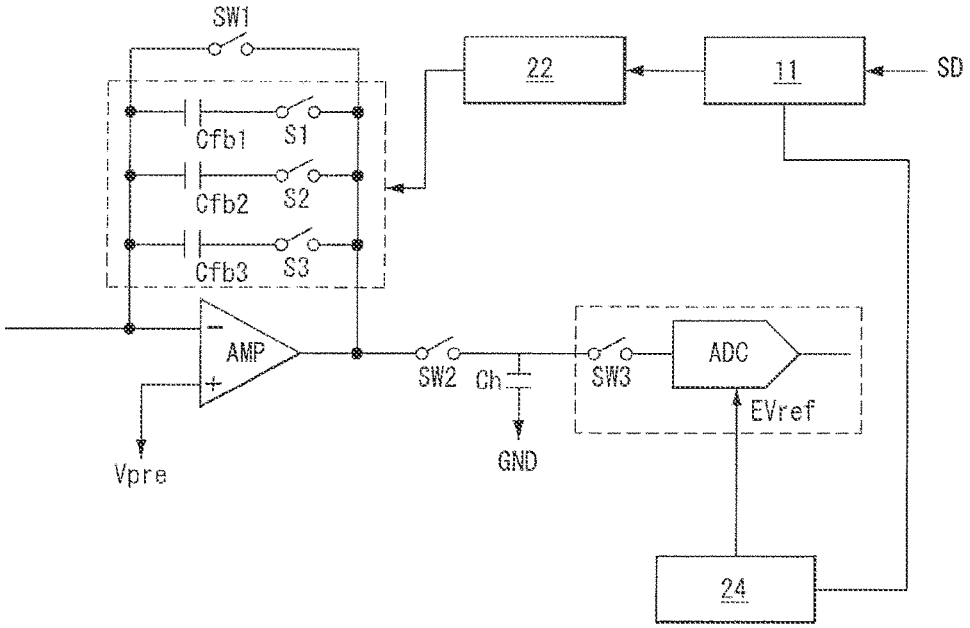
FIGS. 13 to 15 show other solutions to prevent ADC over-range according to an embodiment of the present invention.
Figure 14:
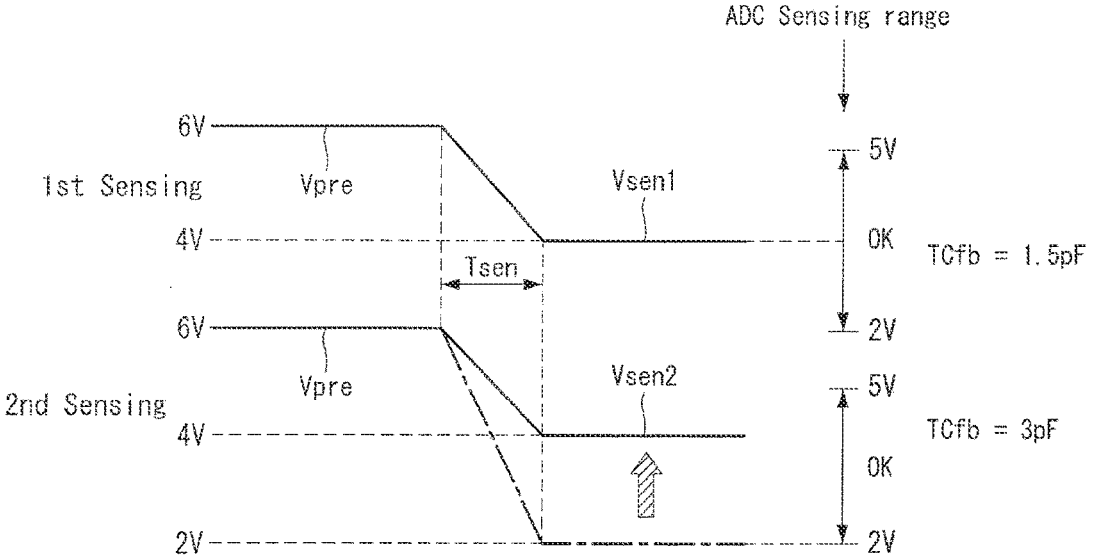
Figure 15:
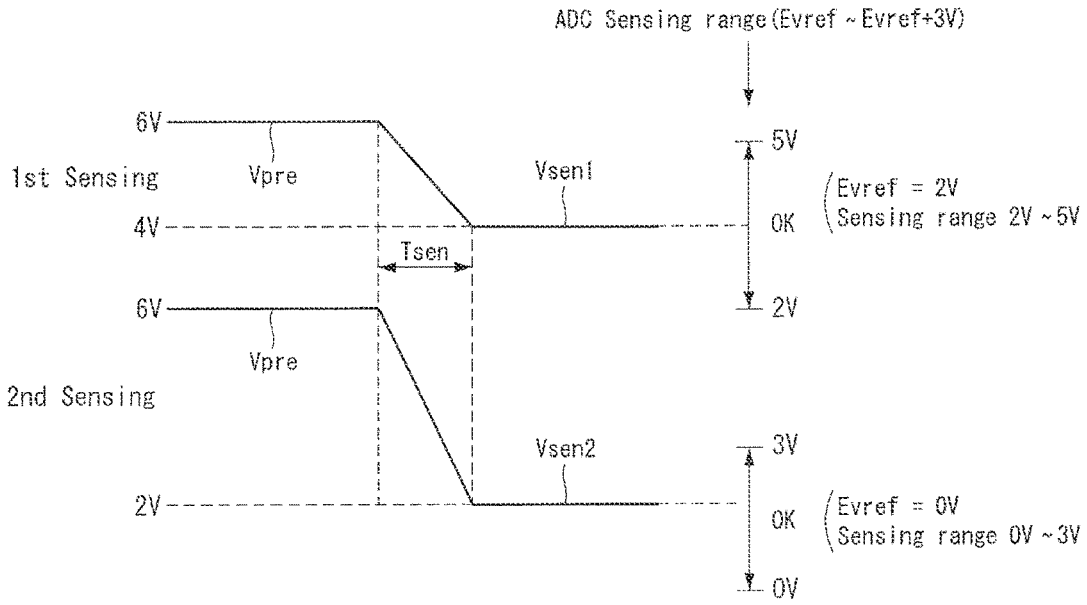

FIGS. 13 to 15 show other solutions to prevent ADC over-range according to an embodiment of the present invention.

Referring to FIG. 13, the organic light emitting display of the present invention may further comprise a capacitance controller 22 for adjusting the capacitance of the integration capacitor Cfb included in the current integrator CI under the control of the timing controller 11. The integration capacitor Cfb comprises a plurality of capacitors Cfb1, Cfb2, and Cfb2 connected in parallel to the inverting input terminal (−) of the amplifier AMP. The other end of each of the capacitors Cfb1, Cfb2, and Cfb2 may be connected to the output terminal of the amplifier AMP through different capacitance adjustment switches S1, S2, and S3. The coupling capacitance of the integration capacitor Cfb is determined depending on the number of turned-on capacitance adjustment switches S1, S2, and S3.

The timing controller 11 analyzes digital sensed values SD, and controls the operation of the capacitance controller 22 according to the ratio of digital sensed values SD equal to the smallest and largest values from the ADC among all the digital sensed values SD to generate a proper switching control signal. The capacitance adjustment switches S1, S2, and S3 are turned on/off in response to the switching control signal from the capacitance controller 22. The larger the coupling capacitance of the integration capacitor Cfb, the gentler the falling slope of the output Vout of the current integrator CI. On the contrary, the smaller the coupling capacitance of the integration capacitor Cfb, the steeper the falling slope of the output Vout of the current integrator CI.

Accordingly, the timing controller 11 controls the number of capacitance adjustment switches S1, S2, and S3 turned on by the capacitance controller 22 to increase the coupling capacitance of the integration capacitor Cfb if underflow occurs where the ADC's output is smaller than the smallest value of the input voltage range and on the contrary decrease the coupling capacitance of the integration capacitor Cfb if overflow occurs where the ADC's output is larger than the largest value of the input voltage range.

FIG. 14 depicts an example of preventing ADC over-range by controlling the coupling capacitance of the integration capacitor Cfb according to an embodiment of the present invention. In the multi-time current sensing method according to the present invention, as shown in FIG. 14, the second integrated value Vsen2 will overflow more likely in the second sensing & sampling period S&S2, in which the falling slope of the output Vout of the current integrator CI is larger, than in the first sensing & sampling period S&S1, in which the falling slope of the output Vout of the current integrator CI is smaller.

In this case, the second integrated value Vsen2 can be adjusted upward from 2V to 4V for correction to satisfy the input voltage range (2V to 5V) of the ADC by increasing the coupling capacitance 3 pF of the integration capacitor Cfb operating during the second sensing & sampling period by two times the coupling capacitance 1.5 pF of the integration capacitor Cfb operating during the first sensing & sampling period.

Referring to FIG. 13, the organic light emitting display of the present invention may further comprise a programmable voltage adjustment IC 24 for adjusting ADC reference voltage Evref under the control of the timing controller 11.

The timing controller 11 analyzes digital sensed values SD, and controls the operation of the programmable voltage adjustment IC 24 according to the percentage of digital sensed values SD equal to the smallest and largest values from the ADC to adjust the ADC reference voltage Evref.

FIG. 15 depicts an example of preventing ADC over-range by adjusting ADC reference voltage Evref according to an embodiment of the present invention. In the multi-time current sensing method according to the present invention, as shown in FIG. 15, the second integrated value Vsen2 will underflow more likely in the second sensing & sampling period S&S2, in which the falling slope of the output Vout of the current integrator CI is larger, than in the first sensing & sampling period S&S1, in which the falling slope of the output Vout of the current integrator CI is smaller.

In this case, the ADC reference voltage Evref used to digitize the first integration value Vsen1 of 4V is maintained at the original level of 2V, and the ADC reference voltage Evref used to digitize the second integrated value Vsen2 of 2V is adjusted downward from the original level of 2V to 0V. By this downward adjustment, the second integrated value Vsen2 will be sufficient to satisfy the input voltage range (0V to 3V) of the ADC.

As described above in detail, the present invention can greatly reduce the sensing time required to sense variations in electrical characteristics of a driving element by implementing low-current sensing and high-speed sensing by a current sensing method using a current integrator. Moreover, the present invention can greatly increase sensing accuracy by performing multi-time sensing on each pixel within one line sensing ON time.

From the foregoing description, those skilled in the art will readily appreciate that various changes and modifications can be made without departing from the technical idea of the present invention. Therefore, the technical scope of the present invention is not limited to the contents described in the detailed description of the specification but defined by the appended claims.

What is claimed is:

1. An organic light emitting display comprising:

a display panel with a plurality of pixels, each pixel comprising an organic light emitting diode (OLED) and a driving thin film transistor (TFT) for controlling an amount of light emission of the OLED and being connected to any one of data lines, any one of gate lines, and any one of sensing lines;

a gate driving circuit that generates a sensing gate pulse corresponding to one line sensing ON time defined by a ON pulse region of the sensing gate pulse in a sensing operation and sequentially supplies the sensing gate pulse to the gate lines in a line sequential manner, wherein the sensing operation includes an initialization, a sensing, and a sampling performed in an initialization period, a sensing period, and a sampling period, respectively;

a data driving circuit comprising:

a plurality of digital-to-analog converters (DACs) that generate a sensing data voltage and supply the sensing data voltage to the data lines within the initialization period of the one line sensing ON time in the sensing operation, a plurality of current integrators that perform an integration of a source-drain current of the driving TFT of each pixel input through the sensing lines in the sensing period, wherein the source-drain current entering through the sensing lines is converted into an integrated value through an integration capacitor, a plurality of samplers each of which includes:

a first switch directly connected to the integration capacitor and configured to pass the integrated value in the sensing period, a holding capacitor configured to store the integrated value when the first switch is turned on in the sensing period, and a second switch configured to be turned on in a predetermined time after the first switch is turned off to pass the integrated value stored in the holding capacitor in the sampling period;

an analog-to-digital converter (ADC) that converts the integrated value stored in the holding capacitor into a digital sensed value; and a timing controller that controls the gate driving circuit and data driving circuit to perform the integration of the source-drain current and derives a threshold voltage variation and a mobility variation of the driving TFT using the digital sensed value.

2. The organic light emitting display of claim 1, wherein the source-drain current includes a first source-drain current caused by a first level of the sensing data voltage and a second source-drain current caused by a second level of the sensing data voltage within the one line sensing ON time.

3. The organic light emitting display of claim 2, wherein the first level of the sensing data voltage is a voltage level corresponding to a predetermined region of a low grayscale current in an entire grayscale range and the second level of the sensing data voltage is a voltage level corresponding to a predetermined region of a high grayscale current in the entire grayscale region.

4. The organic light emitting display of claim 2, wherein the first level of the sensing data voltage is a voltage level corresponding to a predetermined region of a high grayscale current in an entire grayscale range and the second level of the sensing data voltage is a voltage level corresponding to a predetermined region of a low grayscale current in the entire grayscale region.

5. The organic light emitting display of claim 1, wherein the timing controller controls the gate driving circuit to generate the sensing gate pulse in multiple pulses so that two or more of the ON pulse region of the sensing gate pulse are included in the one line sensing ON time.

6. The organic light emitting display of claim 1, wherein the timing controller controls a sensing period in a first sensing & sampling period and a sensing period in a second sensing & sampling period according to a level of the sensing data voltage to differ in length from each other, and sensing periods are adjusted to be inversely proportional to the level of the sensing data voltage.

7. The organic light emitting display of claim 1, wherein the organic light emitting display further comprises a capacitance controller for adjusting a capacitance of the integration capacitor included in the current integrator, the integration capacitor comprising a plurality of capacitors connected in parallel to an inverting input terminal of an amplifier, the other end of each of the capacitors being connected to an output terminal of the amplifier through different capacitance adjustment switches, and wherein the timing controller controls an operation of the capacitance controller based on a result of analysis of the digital sensed values input form the ADC to generate a switching control signal for turning on/off the capacitance adjustment switches.

8. The organic light emitting display of claim 1, wherein the organic light emitting display further comprises a programmable voltage adjustment IC for adjusting an ADC reference voltage by which an input voltage range of the ADC is determined, and wherein the timing controller controls an operation of the programmable voltage adjustment IC based on a result of analysis of the digital sensed values to adjust the ADC reference voltage.

9. An organic light emitting display comprising:

a plurality of pixels in a display panel, each pixel including an organic light emitting diode (OLED) and a driving thin film transistor (TFT) connected to one of data lines, gate lines, and sensing lines, respectively;

a gate driver configured to generate a sensing gate pulse corresponding to one line sensing ON time defined by a ON pulse region of the sensing gate pulse in a sensing operation and sequentially supply the sensing gate pulse to the gate lines in a line sequential manner, wherein the sensing operation includes initialization, sensing, and sampling operations performed in an initialization period, a sensing period, and a sampling period, respectively;

a data driver including a digital-to-analog converter (DAC), a current integrator, a sampler, and an analog-to-digital converter (ADC), wherein the DAC supplies a sensing data voltage to the data lines in the initialization period of the one line sensing ON time in the sensing operation, wherein the current integrator including an amplifier and an integration capacitor performs an integration of a source-drain current of the driving TFT of each pixel input through the sensing lines in the sensing period, the source-drain current entering through the sensing lines being converted into an integrated value through the integration capacitor, wherein the sampler includes:

a first switch directly connected to the integration capacitor and configured to pass the integrated value in the sensing period, a holding capacitor configured to store the integrated value when the first switch is turned on in the sensing period, and a second switch configured to be turned on in a predetermined time after the first switch is turned off to pass the integrated value stored in the holding capacitor in the sampling period, and wherein the ADC converts the integrated value stored in the holding capacitor of the sampler into a digital sensed value; and a timing controller configured to control the gate and data drivers to perform the integration of the source-drain current and derive a threshold voltage variation and a mobility variation of the driving TFT using the digital sensed value.

10. The organic light emitting display of claim 9, wherein the timing controller controls the gate driver to generate the sensing gate pulse in multiple pulses so that two or more of the ON pulse region of the sensing gate pulse are included in the one line sensing ON time.

11. The organic light emitting display of claim 9, wherein the timing controller controls a sensing period in a first sensing & sampling period and a sensing period in a second sensing & sampling period according to a level of the sensing data voltage to differ in length from each other, and sensing periods are adjusted to be inversely proportional to the level of the sensing data voltage.

12. The organic light emitting display of claim 9, further comprising:

a programmable voltage adjustment IC for adjusting an ADC reference voltage by which an input voltage range of the ADC is determined, wherein the timing controller controls an operation of the programmable voltage adjustment IC based on a result of analysis of the digital sensed values to adjust the ADC reference voltage.

* * * * *